US006868651B1

(12) United States Patent
Sorensen

(10) Patent No.: US 6,868,651 B1
(45) Date of Patent: Mar. 22, 2005

(54) PACKER APPARATUS, PACKING CONVEYOR AND METHOD

(76) Inventor: Ejler L Sorensen, 15 Westchester Blvd, Bolton, Ontario (CA), L7E 5Y1

( * ) Notice: Subject to any disclaimer, the term of this patent is extended or adjusted under 35 U.S.C. 154(b) by 474 days.

(21) Appl. No.: 09/660,404

(22) Filed: Sep. 12, 2000

(51) Int. Cl.[7] ..... B65B 1/04
(52) U.S. Cl. ..... 53/247; 294/119.1; 294/87.1
(58) Field of Search ..... 53/443, 147, 531, 53/542, 247; 211/124; 294/119.1, 87.26, 87.1; 493/473, 479; 269/43, 45, 258; 29/281.1

(56) References Cited

U.S. PATENT DOCUMENTS 3,166,207 A * 1/1965 Quayle ..... 414/621
3,893,574 A * 7/1975 Kamphues ..... 294/63.1
3,910,622 A * 10/1975 Nies ..... 294/87.2
4,120,526 A * 10/1978 Rohner ..... 294/87.1
4,211,056 A * 7/1980 Birk ..... 53/543
4,750,132 A * 6/1988 Pessina et al. ..... 414/751.1
5,127,695 A * 7/1992 Zoeten ..... 294/67.33
5,186,515 A * 2/1993 Goldberg et al. ..... 294/119.1
5,284,003 A * 2/1994 Goodman et al. ..... 53/437
5,655,355 A * 8/1997 Ramler ..... 53/475
5,942,188 A * 8/1999 Lepper et al. ..... 422/62
6,135,435 A * 10/2000 Schmitz ..... 269/164
6,135,704 A * 10/2000 Seaberg ..... 414/791.6
6,196,536 B1 * 3/2001 Hintze ..... 269/282
6,309,003 B1 * 10/2001 Bertini ..... 294/119.1

* cited by examiner

*Primary Examiner*—Eugene Kim
*Assistant Examiner*—John Paradiso

(57) ABSTRACT

A packer for packing cartons into boxes having at least one carton transfer location where cartons accumulate for transfer, a box packing location adjacent the transfer location, clamps for gripping the cartons in a group at the transfer location, the clamps being movable for moving the gripped group of cartons from the transfer location to the packing location, and, being releasable for depositing the group of cartons in the box at the packing location. Also disclosed is a carton gripper for gripping groups of cartons, moving the cartons and for packing the groups into boxes and having, a gripper body, slide rods supported on the gripper body, pairs of clamp bars slideable along the slide rods, and, the gripper being movable moving the pairs of clamp bars towards one another into a gripping position and away from one another into a releasing position. Alos disclosed is a method of gripping a group of cartons and transferring them from a conveyor into a box.

10 Claims, 10 Drawing Sheets

PACKER APPARATUS, PACKING CONVEYOR AND METHOD

FIELD OF THE INVENTION

The invention relates to a packing machine for packing cartons into boxes, and to a packing conveyor for conveying cartons of products to the packing machine, and to a method of packing cartons into boxes

BACKGROUND OF THE INVENTION

Packing cartons of products into boxes is just one of many tasks that are required to provide an efficient and speedy production line. Where the cartons are of simple shape it is not a significant problem. However some product cartons do not lend themselves readily to be automatically handled and packed into boxes. Milk and juice cartons are one example of this type of product carton. Such products are often packaged in cartons that are made of coated paper or board stock, formed into a rectangular shaped tube. The tube is formed with a sealed flat base and is squeezed together at its upper end and is sealed at the top by a heat sealed seam. For efficient handling cartons must be packed into boxes for shipment. These cartons come in a variety of sizes. They may be single serving size, or may hold a pint or a quart of liquid, and in some cases more.

Handling such cartons in an automatic packing line requires that they can be grasped, without squeezing the sides, lifted, in a group, such that the group will fit into one layer of the box, moved over into registration with an open box, lowered into the box, and the group of cartons must then be released in the box. This action must be repeated as often as required to fill the box. When filled the box will be transferred to a box sealer, and a fresh unfilled box moved into its place.

All of these steps must be carried out in a continual sequence so that the packing operation may be incorporated in a continuous moving conveyor line. Grasping of the cartons presents its own problems. Due to the liquid contents of the cartons, they represent relatively substantial weight per unit of carton size. Also due to the liquid content the cartons cannot be grasped by their sides. The sides of the cartons are somewhat thin and flexible, and can be inwardly deflected by even modest pressure. Consequently it is desirable to grasp the cartons and lift them by holding the heat sealed seam along the top. This can withstand substantial pressure. However it is has a relatively low height In addition it is located along a line bisecting the rectangular section of the carton. Thus where cartons of a first size may define a first distance on each side of the seam, cartons of second size, either larger or smaller, will define a second distance on either side of the seam. This difference in size will require adjustment of the spacing between the gripping devices which grip to top seams of the group of boxes.

The packing machine must thus be such that it can, with certain modifications, grasp, lift, transfer and release, groups of cartons which are in a range of different sizes, depending on the size on cartons being filled and packed at a particular time.

Preferably there are two transfer portions of the packing machine. They will move along an axis transverse to the flow path of the conveyor system. It is advantageous if there are two side by side conveyor paths, with the unfilled box being located between them. In this way the packing machine can move a first packing portion from from the one conveyor to the unfilled box. At the same time a second packing portion of the machine is moving from the box location back to the other conveyor. At this point the second packing portion will grasp a group of cartons from the second conveyor line and move over the box, release them and return to the second conveyor line and so on. In this way the cartons on one conveyor can be allowed to accumulate into a group, ready for transfer, while a group of cartons from the other conveyor is being grasped and transferred to the box.

BRIEF SUMMARY OF THE INVENTION

With a view to providing a packing machine having the most of the foregoing features the invention comprises packer apparatus for packing cartons into boxes, and having at least one carton transfer location where cartons accumulate for transfer, a box packing location adjacent the transfer location, means for gripping the cartons in a group at the transfer location, means for moving the gripped group of cartons from the transfer location to the box packing location, and, means for depositing the group of cartons into the box at the packing location.

The invention further comprises packer apparatus having the foregoing advantages and wherein there are two said transfer locations, and wherein cartons accumulate at each said transfer location in respective groups. The invention further comprises packer apparatus having the foregoing advantages and wherein said box packing location is positioned between said two carton transfer locations.

The invention further comprises packer apparatus having the foregoing advantages and wherein said gripper means includes at least one gripper assembly, said assembly having pairs of clamp bars operable towards and away from one another for gripping and for releasing said cartons.

The invention further comprises packer apparatus having the foregoing advantages and wherein said moving means includes a gripper support, said support being moveable from one said carton transfer location to said box packing location, and back again.

The invention further comprises packer apparatus having the foregoing advantages and wherein there are two said gripper assemblies, and wherein said gripper support supports both said gripper assemblies, and wherein movement of said gripper support moves one said gripper assembly from a said transfer location to said box packing station, while said other gripper assembly is moved simultaneously from said box packing location to said other of said transfer locations.

The invention further comprises carton gripper apparatus for gripping groups of cartons for packing said groups into boxes, and having a gripper body member, a plurality of slide rods supported on said gripper body member, a plurality of pairs of clamp bars slidable along said slide rods, and, means for moving said pairs of clamp bars towards one another into a gripping position and away from one another into a releasing position.

The invention further comprises carton gripper apparatus having the foregoing advantages and including bearing openings in said clamp bars, and wherein said slide rods extend through respective said bearing openings.

The invention further comprises carton gripper apparatus having the foregoing advantages and wherein said clamp bars comprise respectively pairs of first and second clamp bars and wherein said first ones of said pairs are secured to first ones of said slide rods, and wherein second ones of said damp bars are secured to second ones of said slide rods.

The invention further comprises a method of gripping groups of cartons and packing the groups of cartons into boxes, using the apparatus described above.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
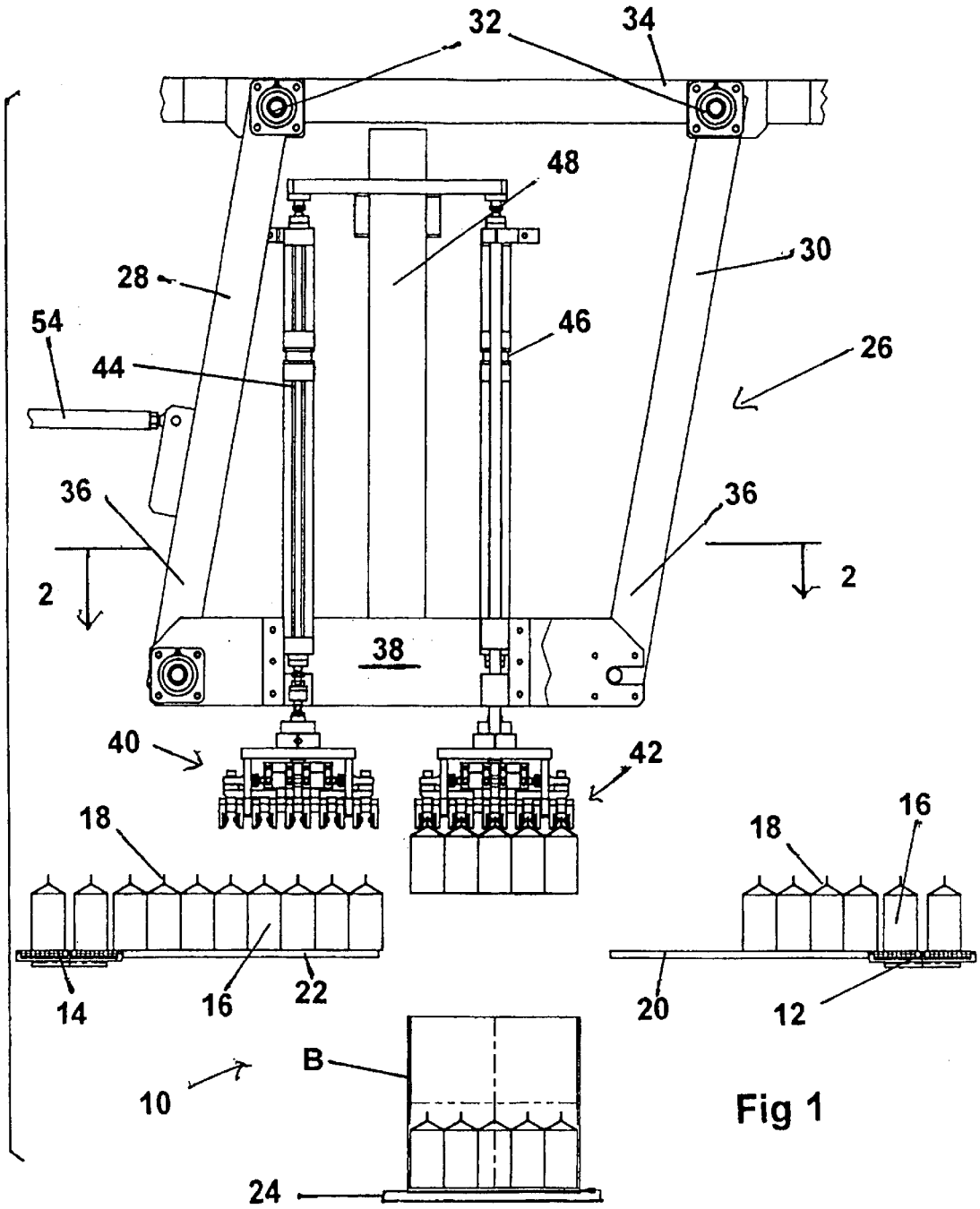
FIG. 1 is a front elevation of a packer station between two conveyor lines, and having a packer apparatus, illustrating the invention.
Figure 2:
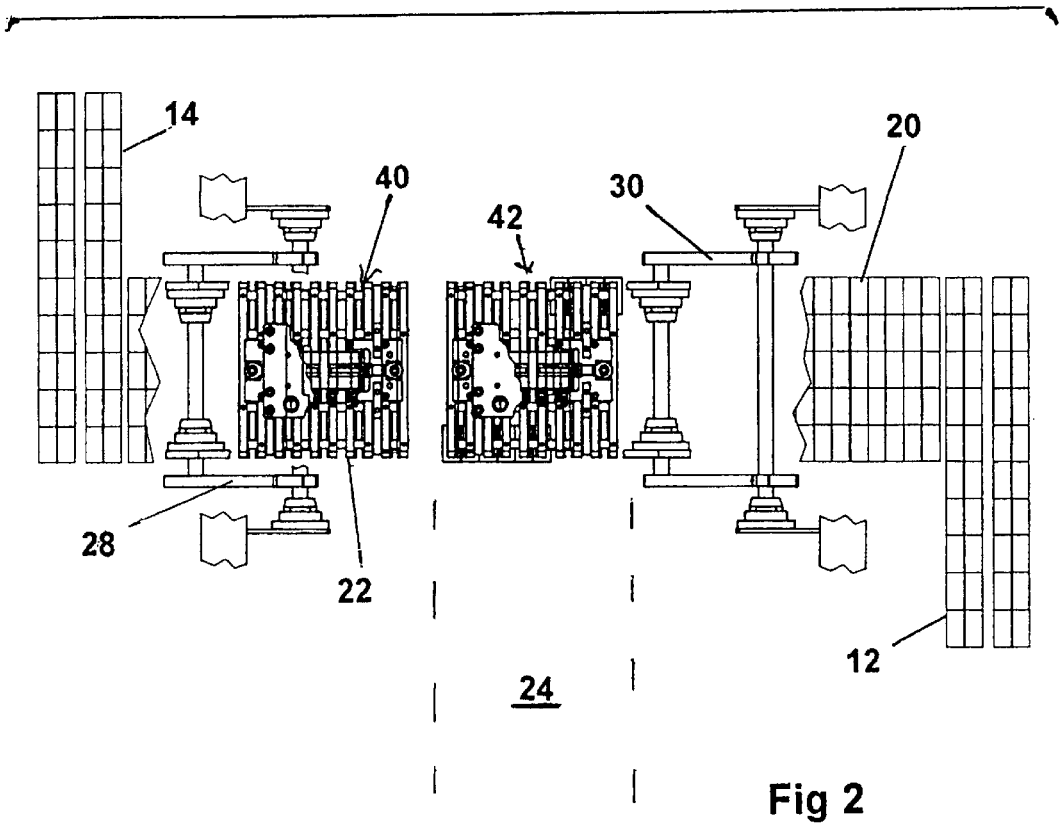
FIG. 2 is a sectional top plan of the packer station of FIG. 1, along the line 2—2 of FIG. 1.
Figure 3:
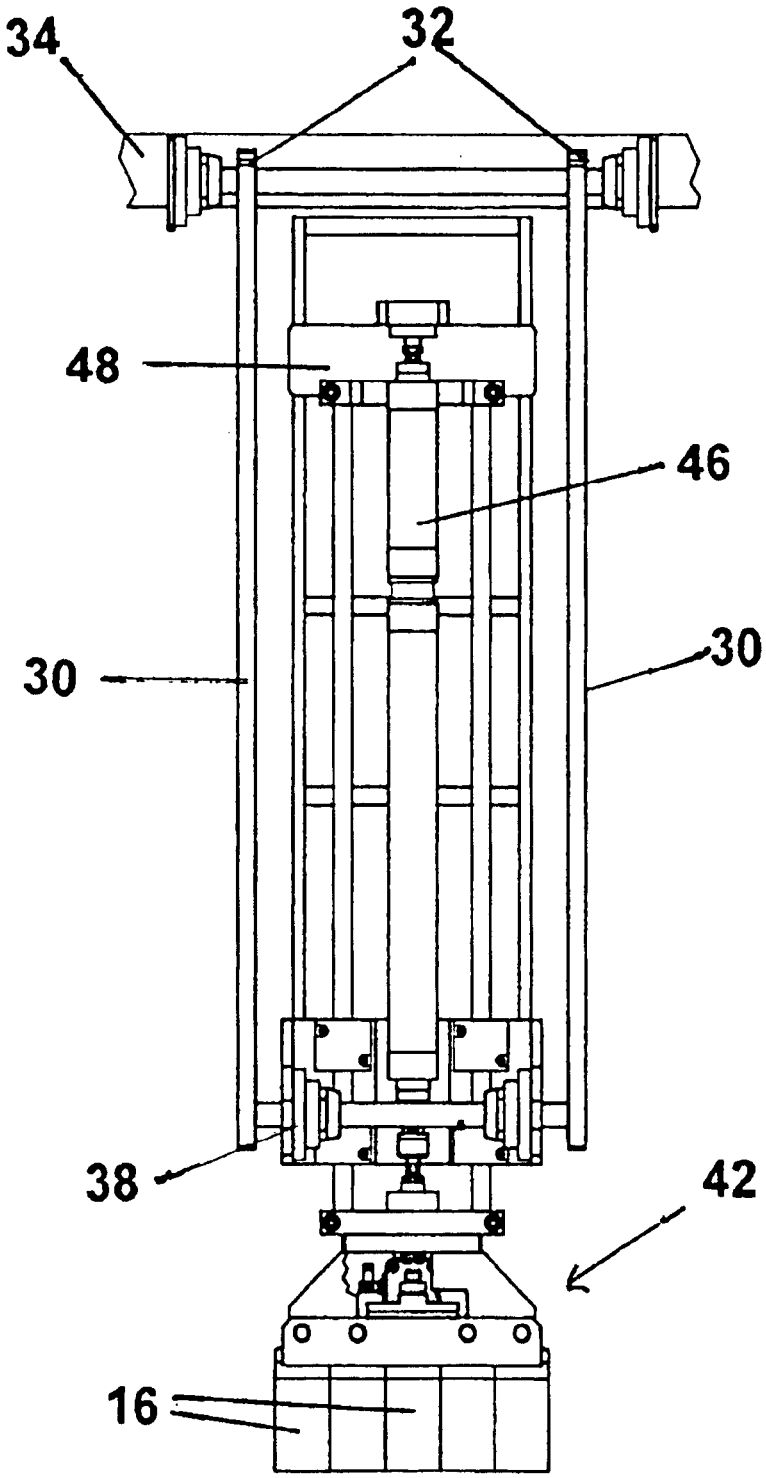
FIG. 3 is a side elevation of the packer station of FIG. 1.
Figure 4:
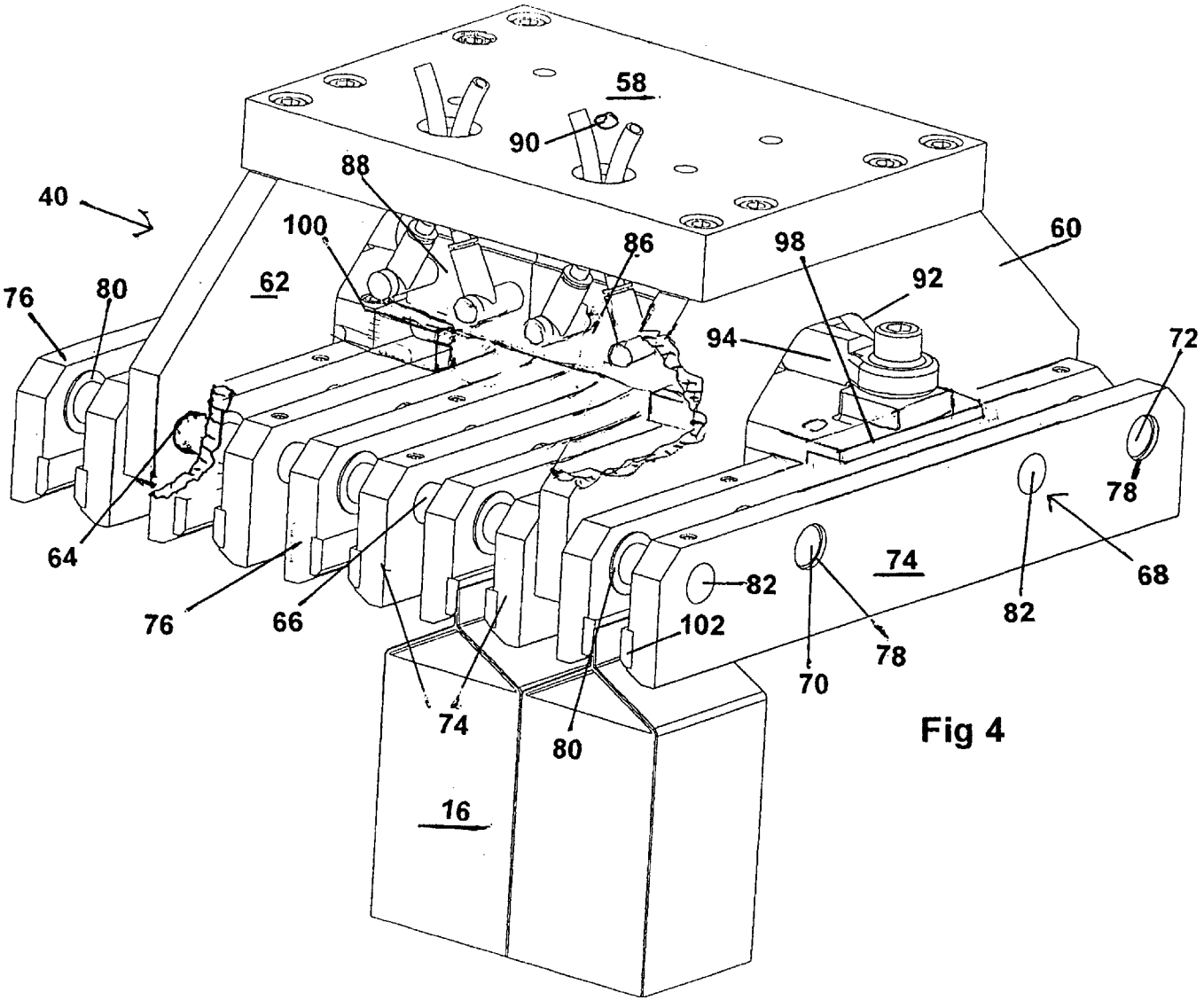
FIG. 4 is an upper perspective of one of the gripper heads of the packing station of FIG. 1.
Figure 5:
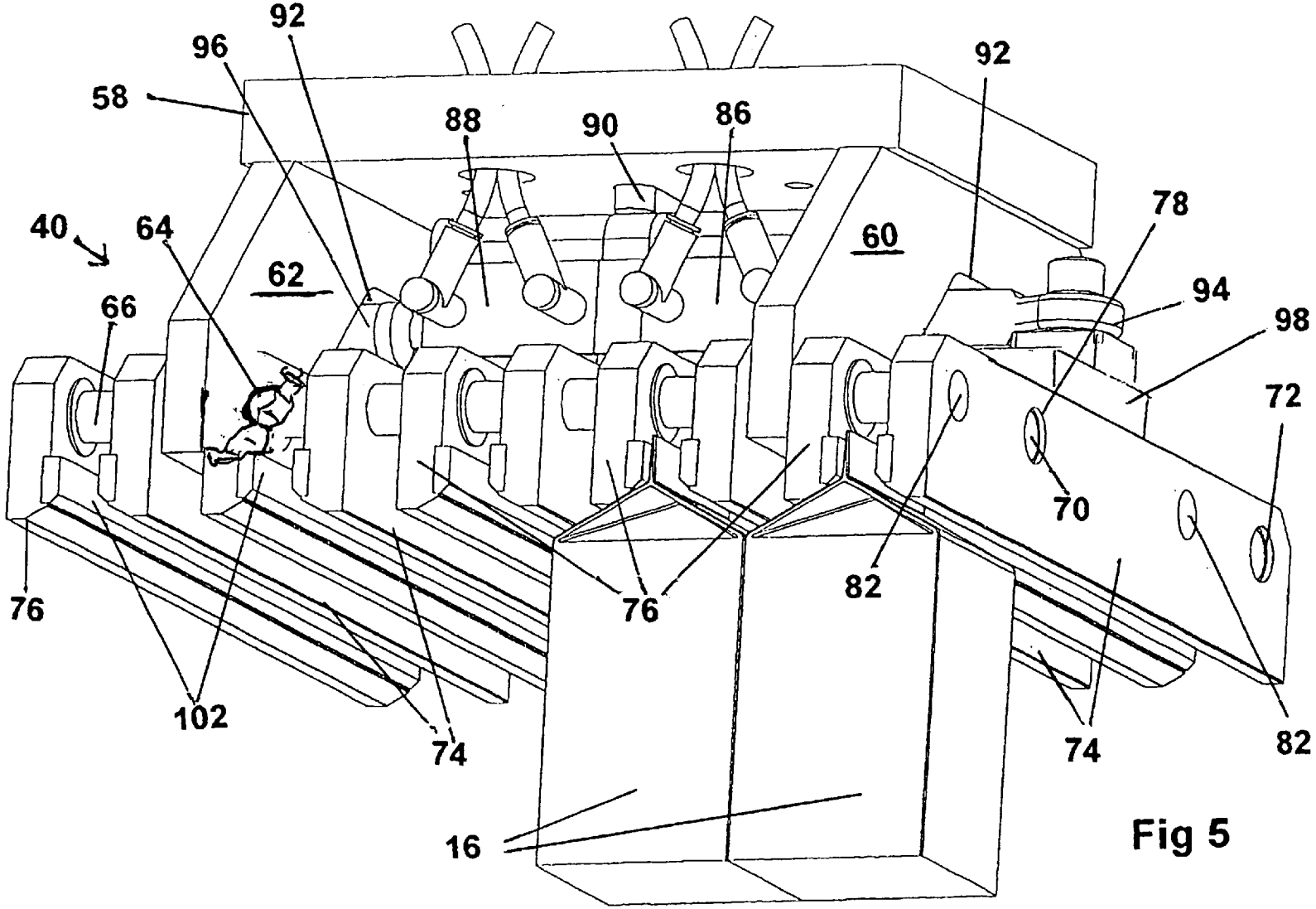
FIG. 5 is a lower perspective of the gripper head of FIG. 4.
Figure 6:
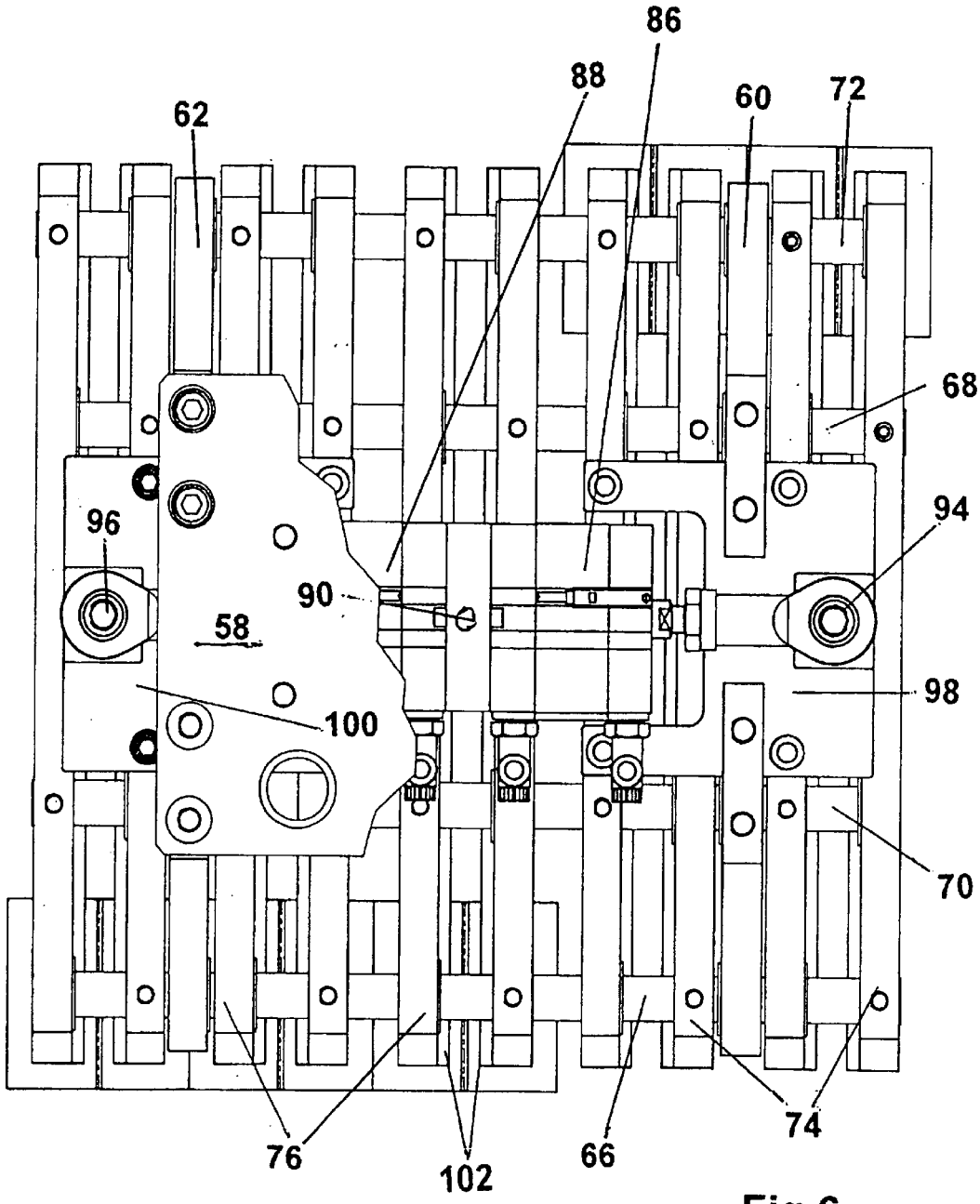
FIG. 6 is a top plan of the gripper head of FIG. 4 partially cut away.
Figure 7:
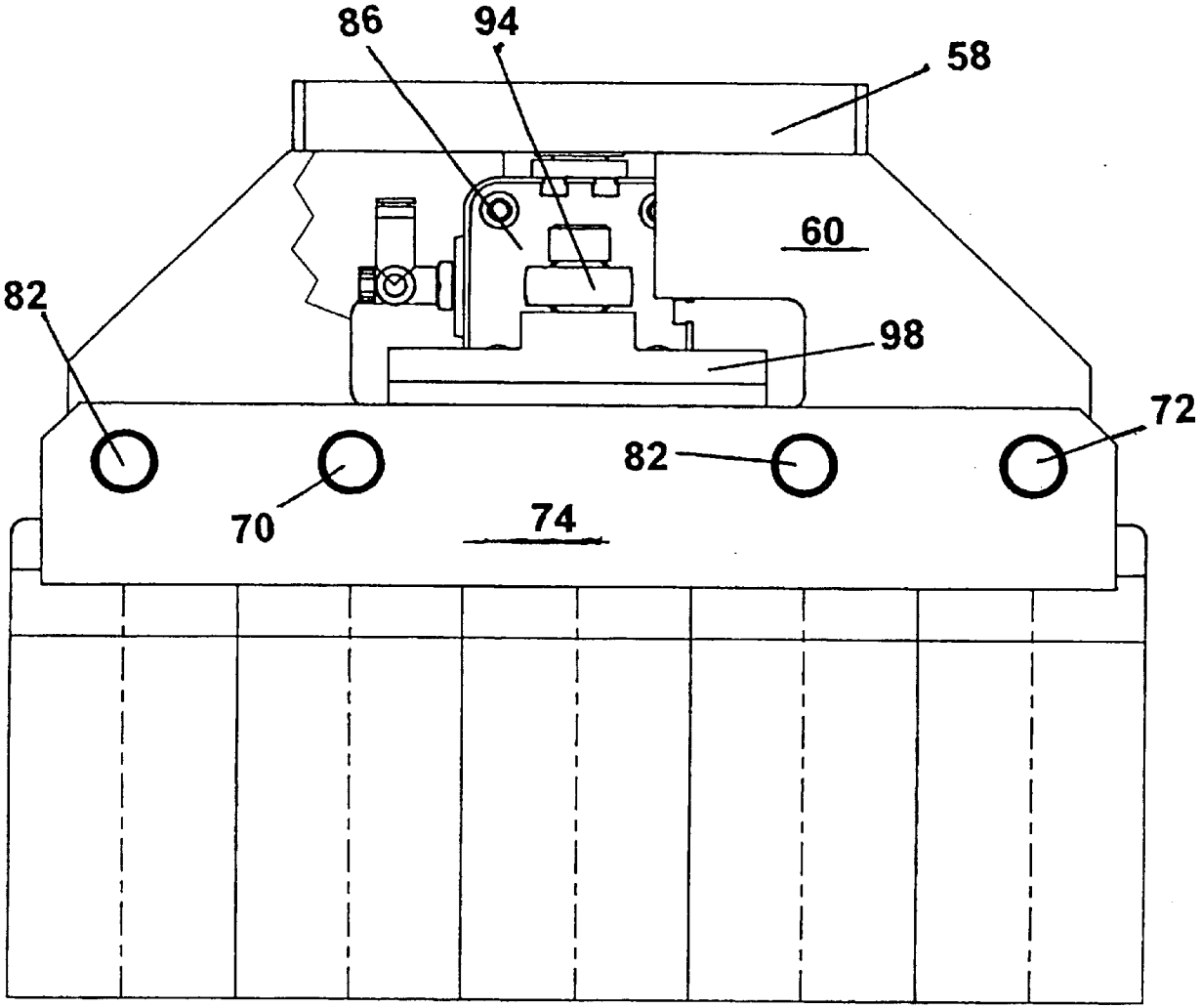
FIG. 7 is a side elevation of the gripper head of FIG. 4.
Figure 8:
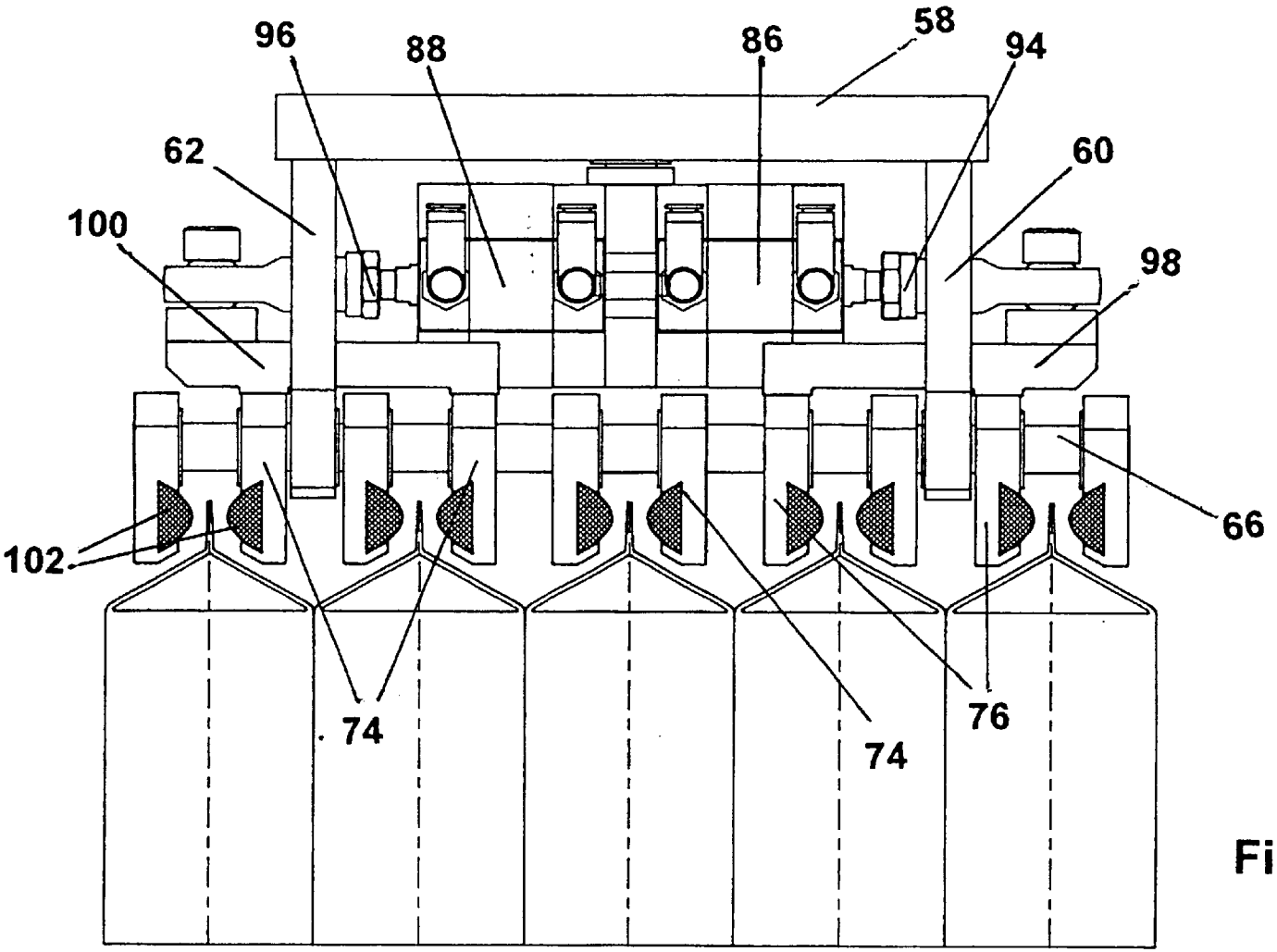
FIG. 8 is a front elevation of the gripper head of FIG. 4.
Figure 9:
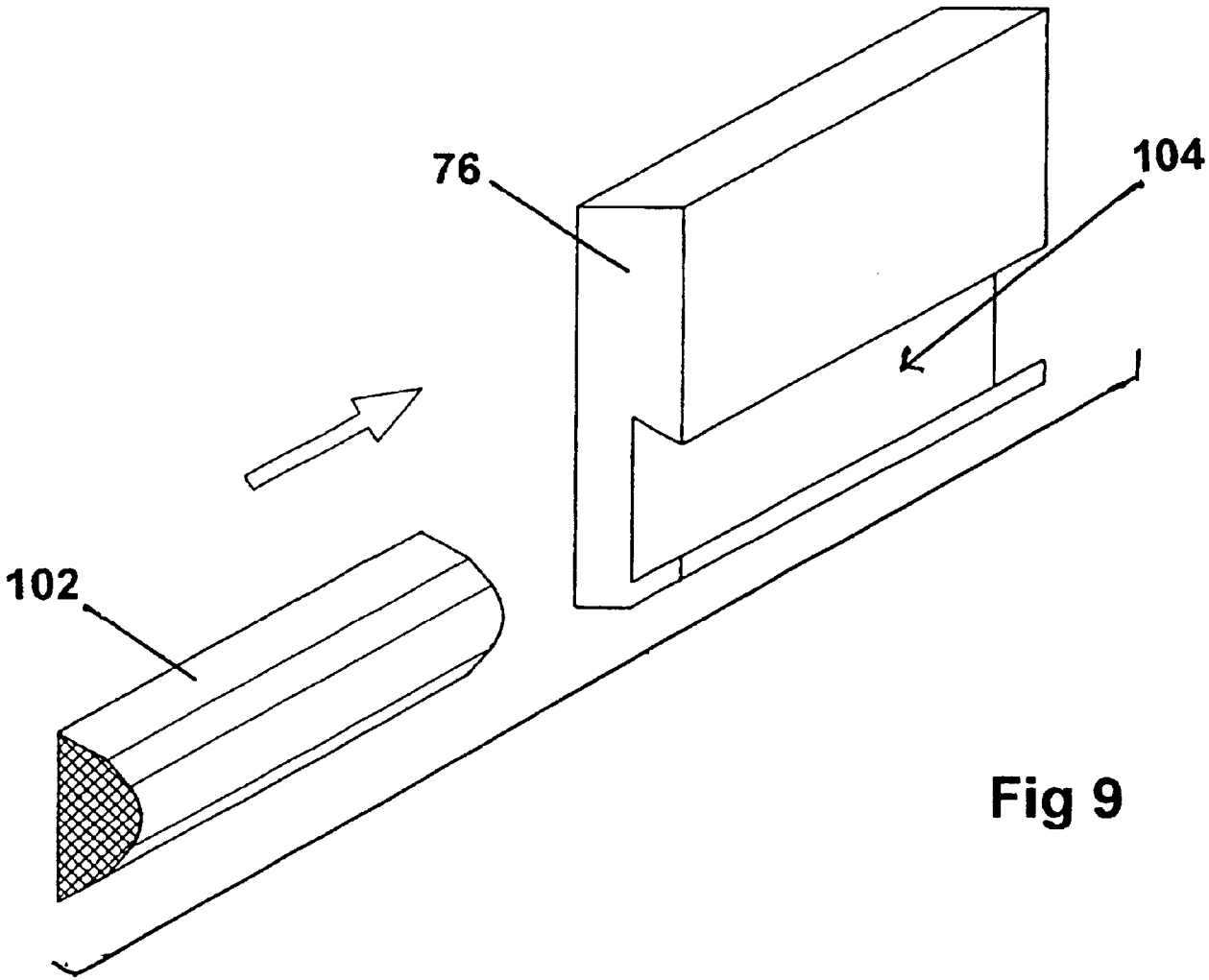
FIG. 9 is an exploded view of one of the gripper plates showing a frictional portion thereof separate from the plate.
Figure 10:
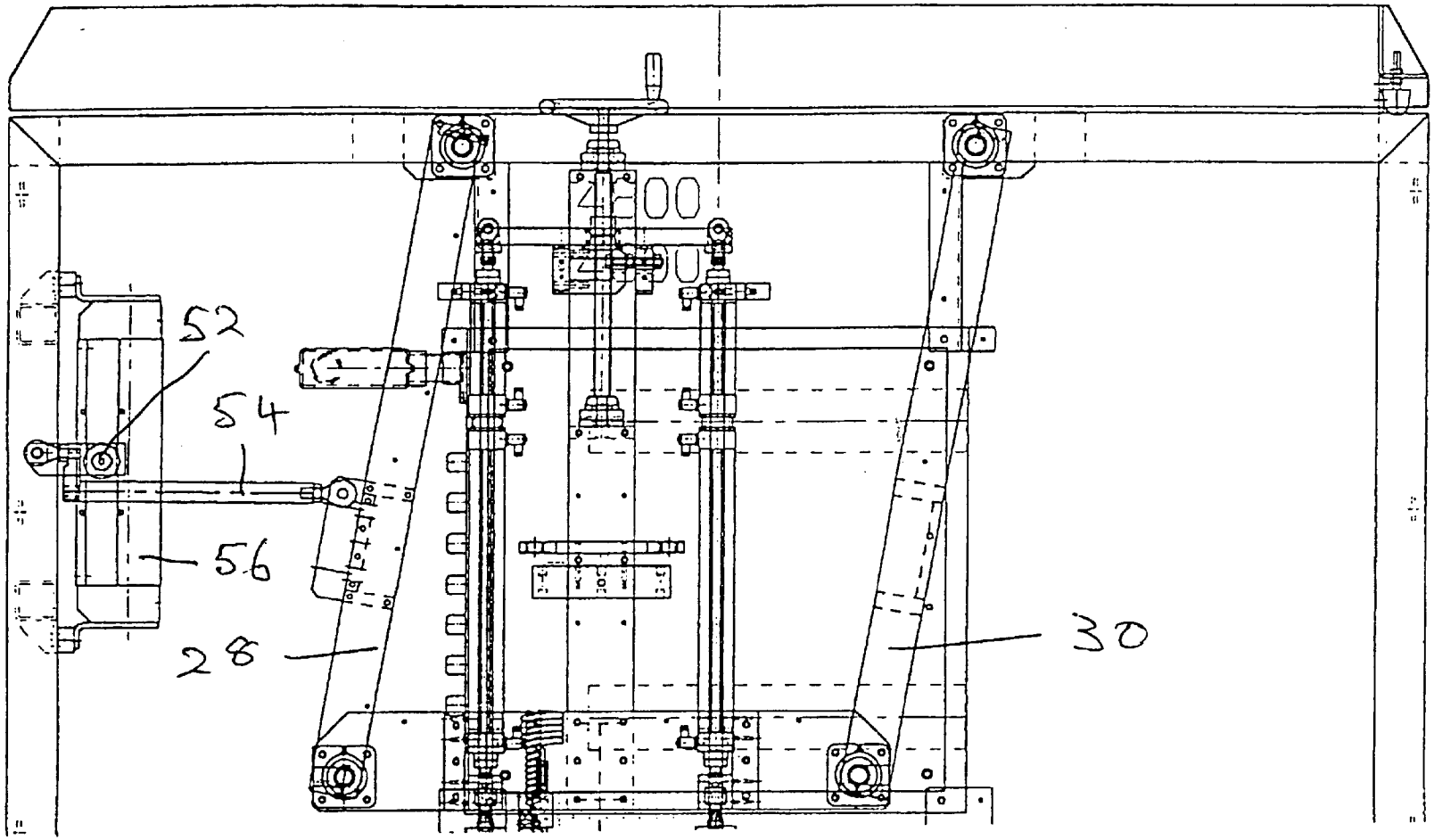
FIG. 10 is a partial elevation of the upper portion of the apparatus, showing the movement mechanism.
Figure 1:
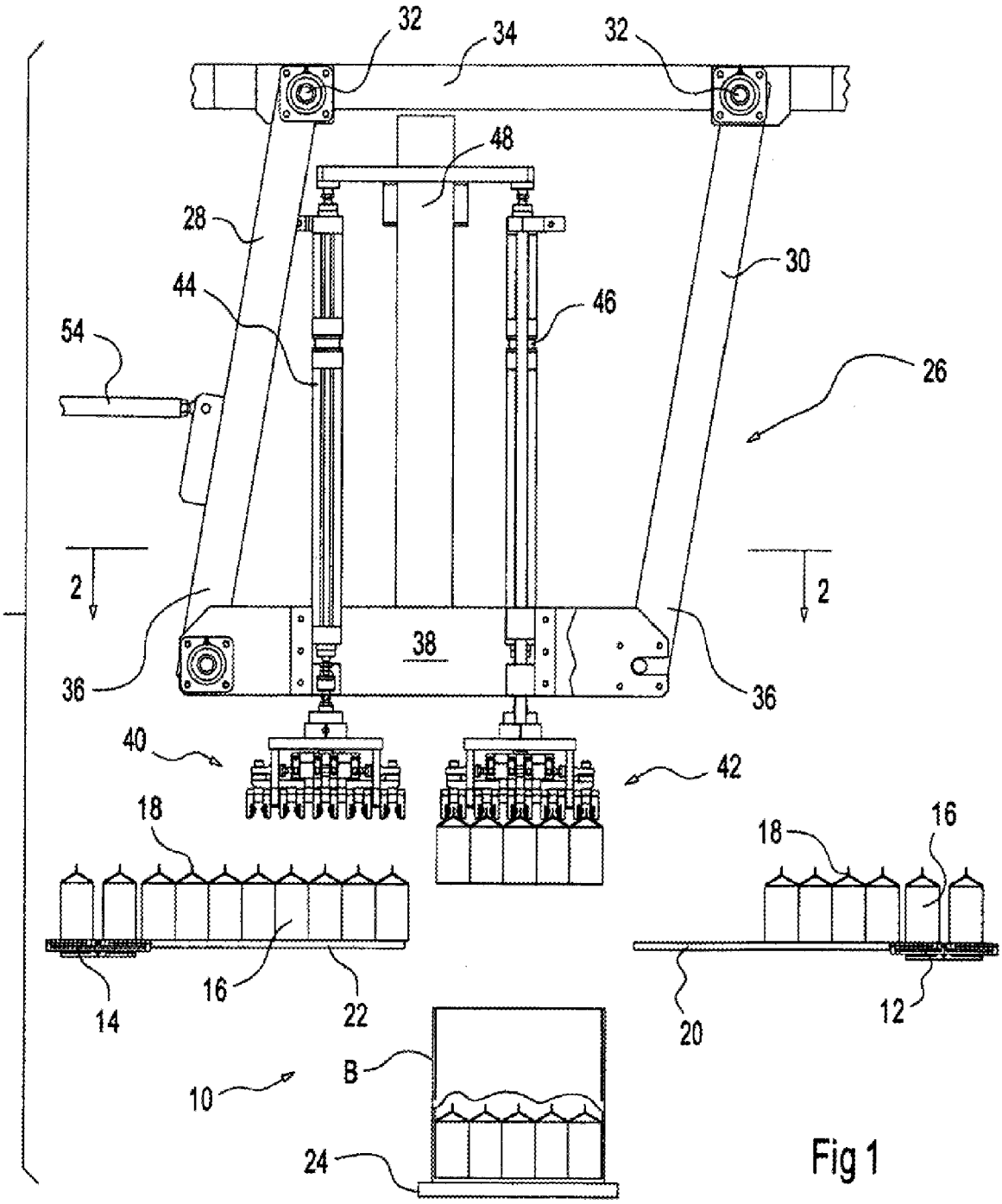
Figure 2:
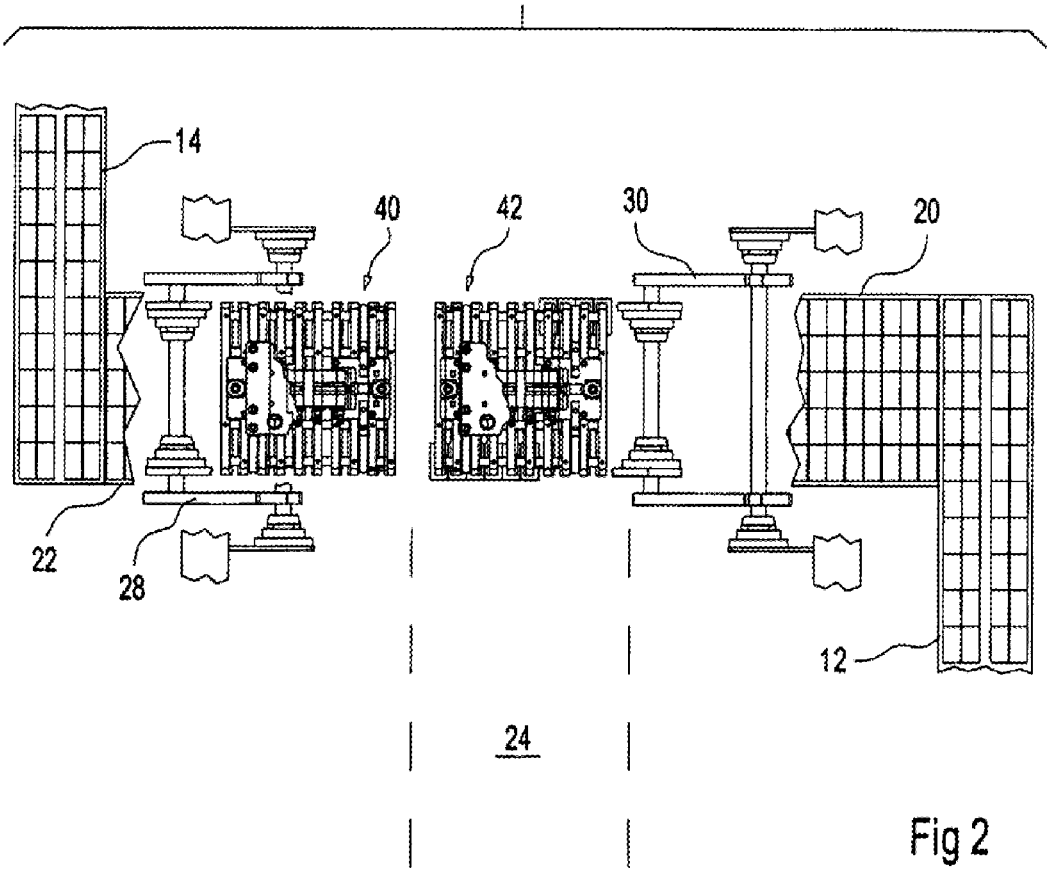
Figure 3:
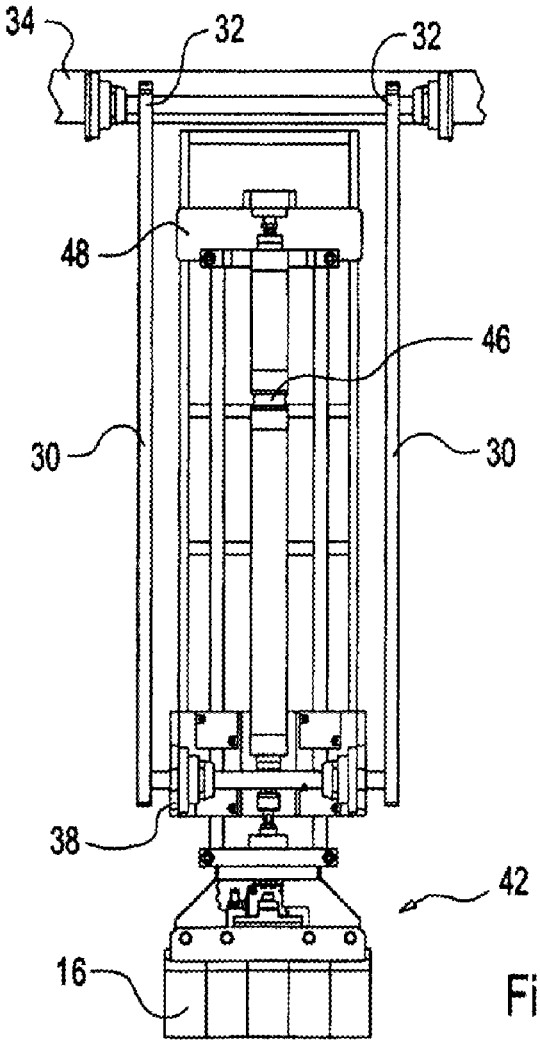
Figure 4:
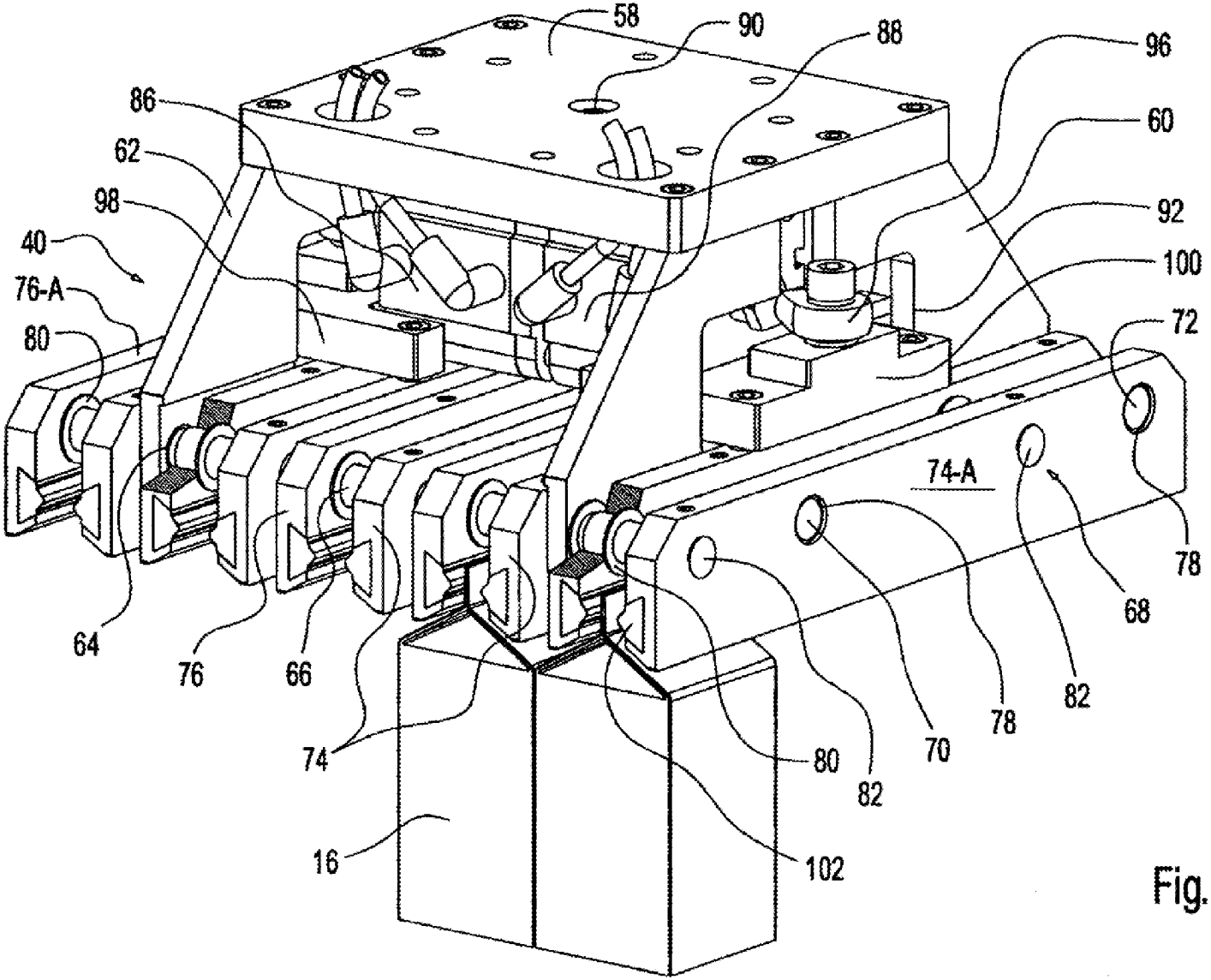
Figure 5:
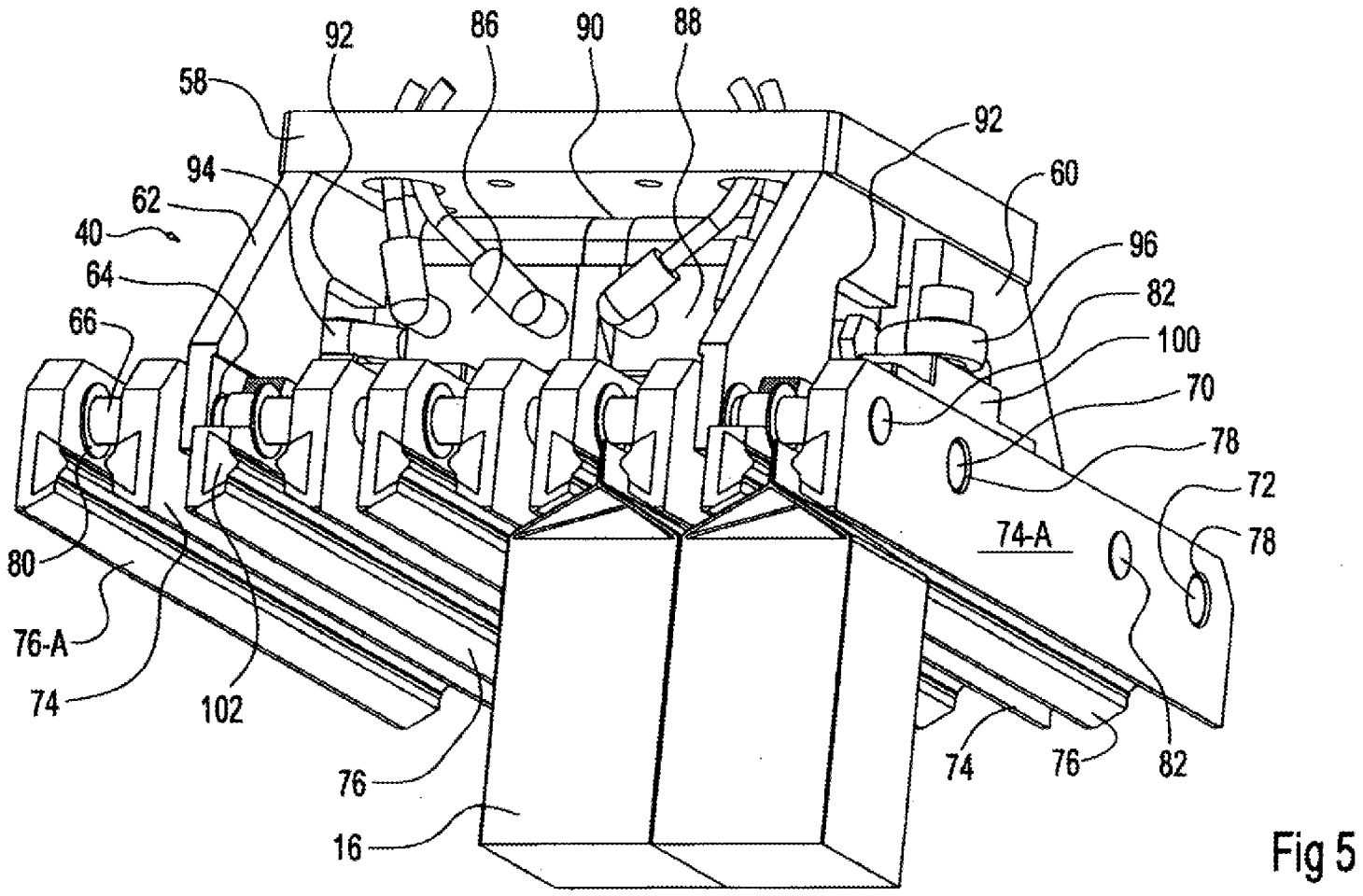
Figure 6:
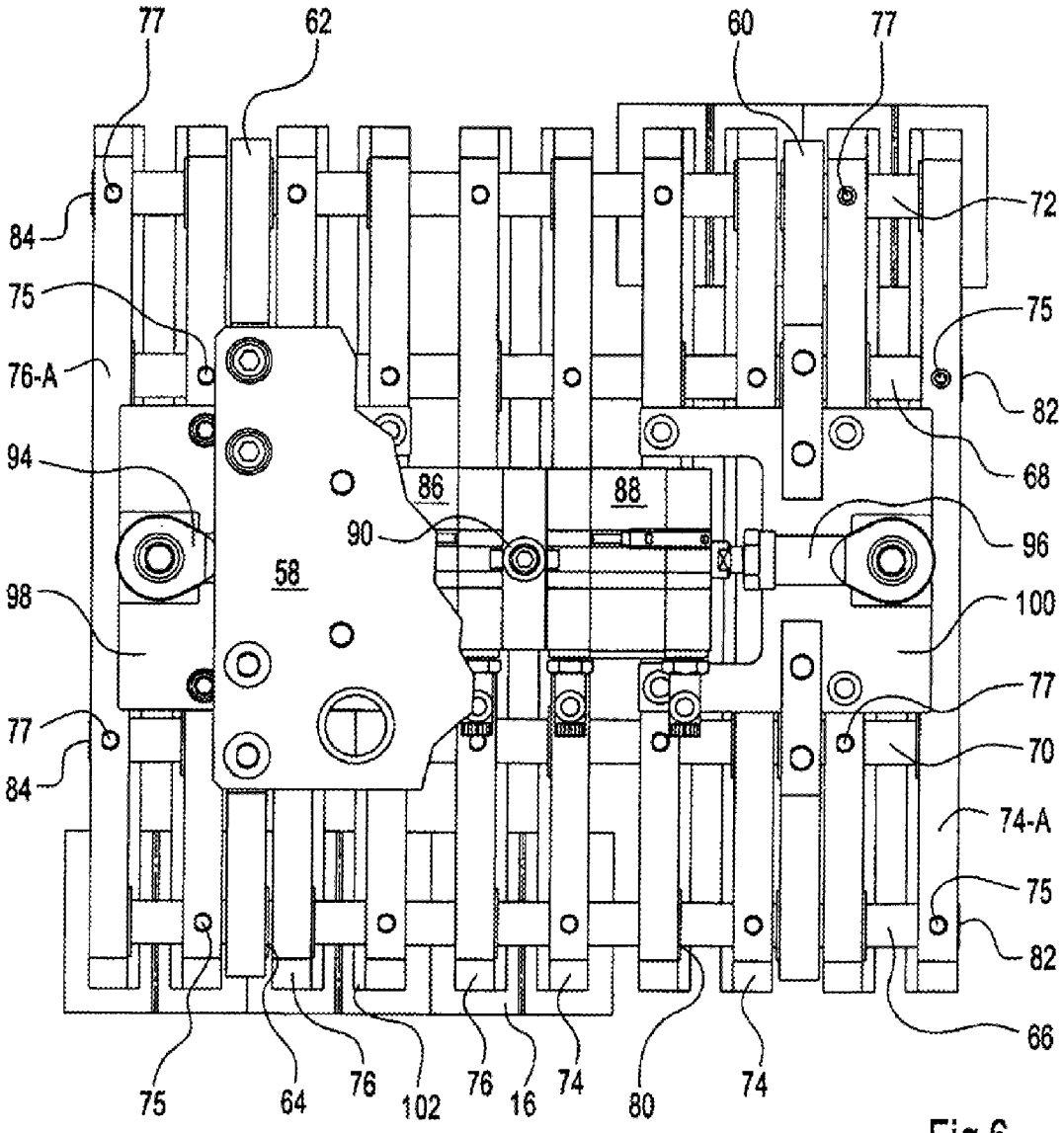
Figure 7:
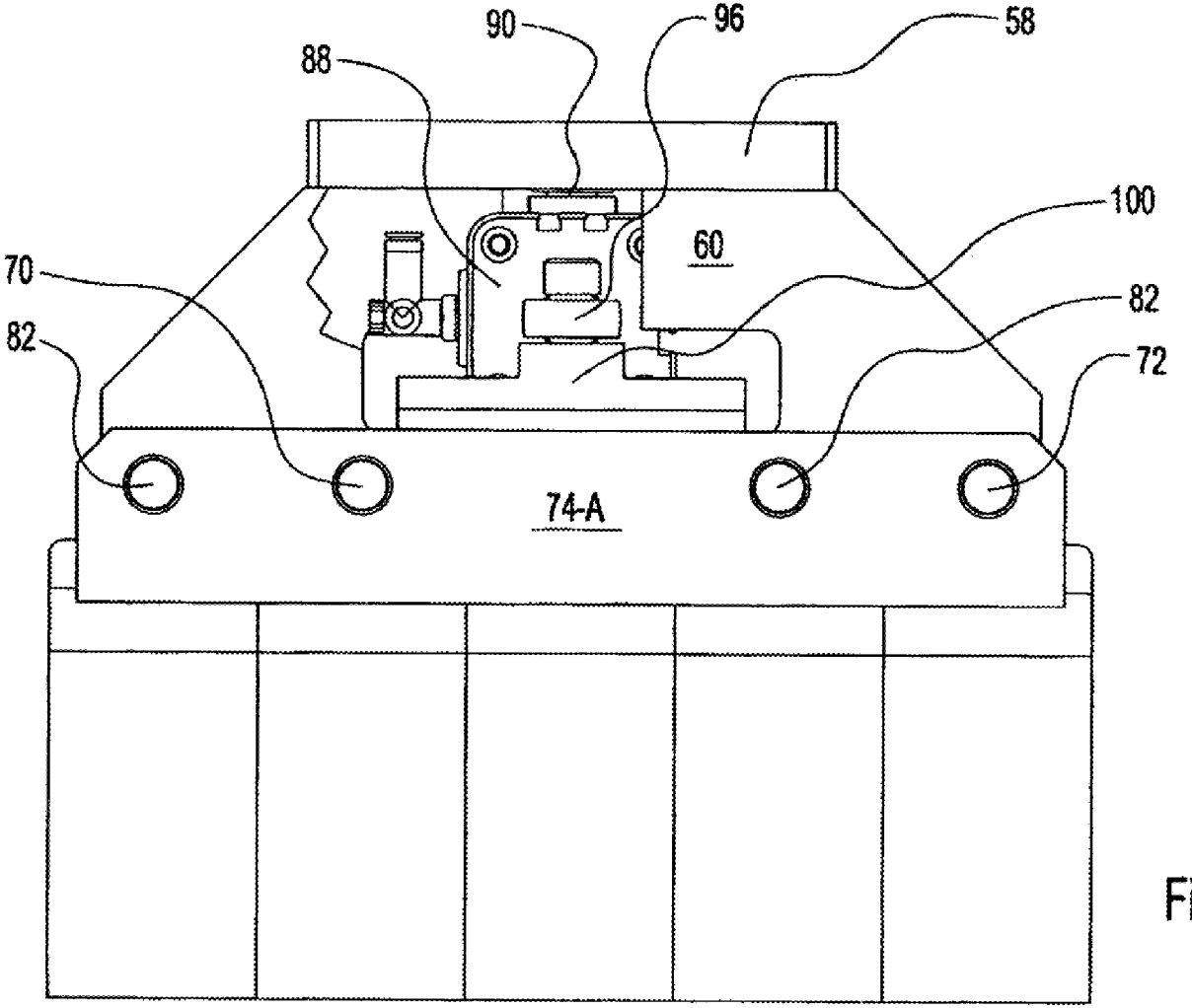
Figure 8:
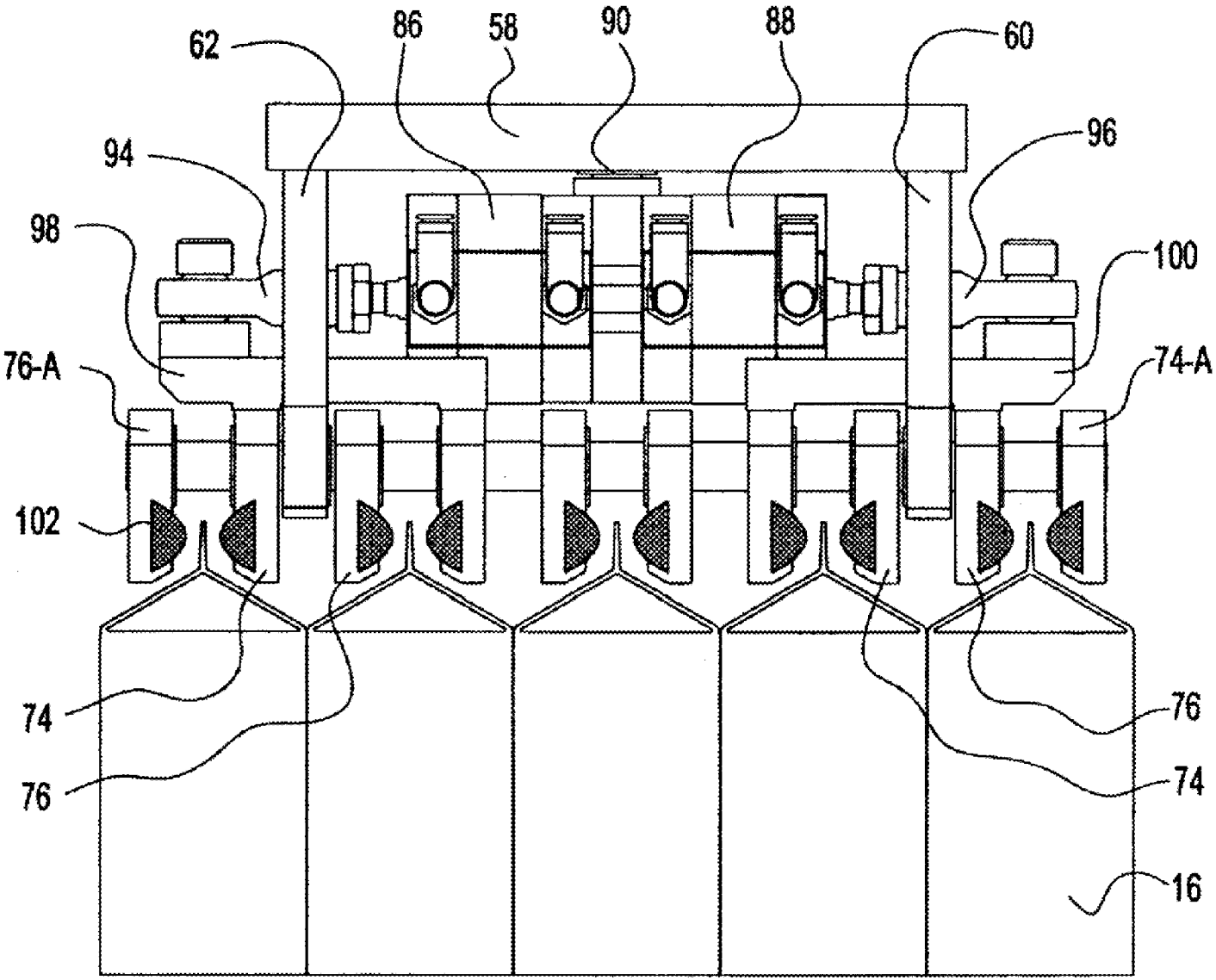
Figure 9:
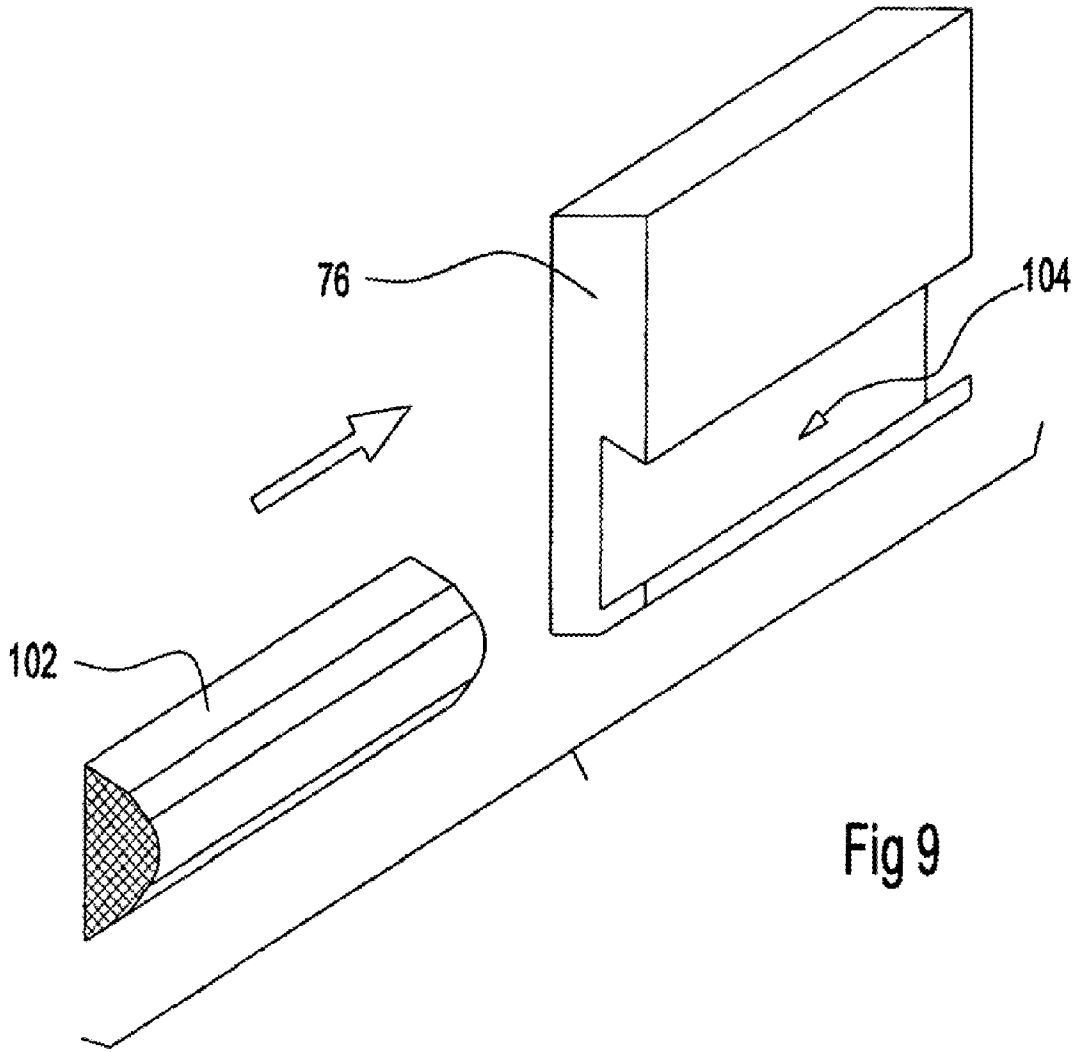
Figure 10:
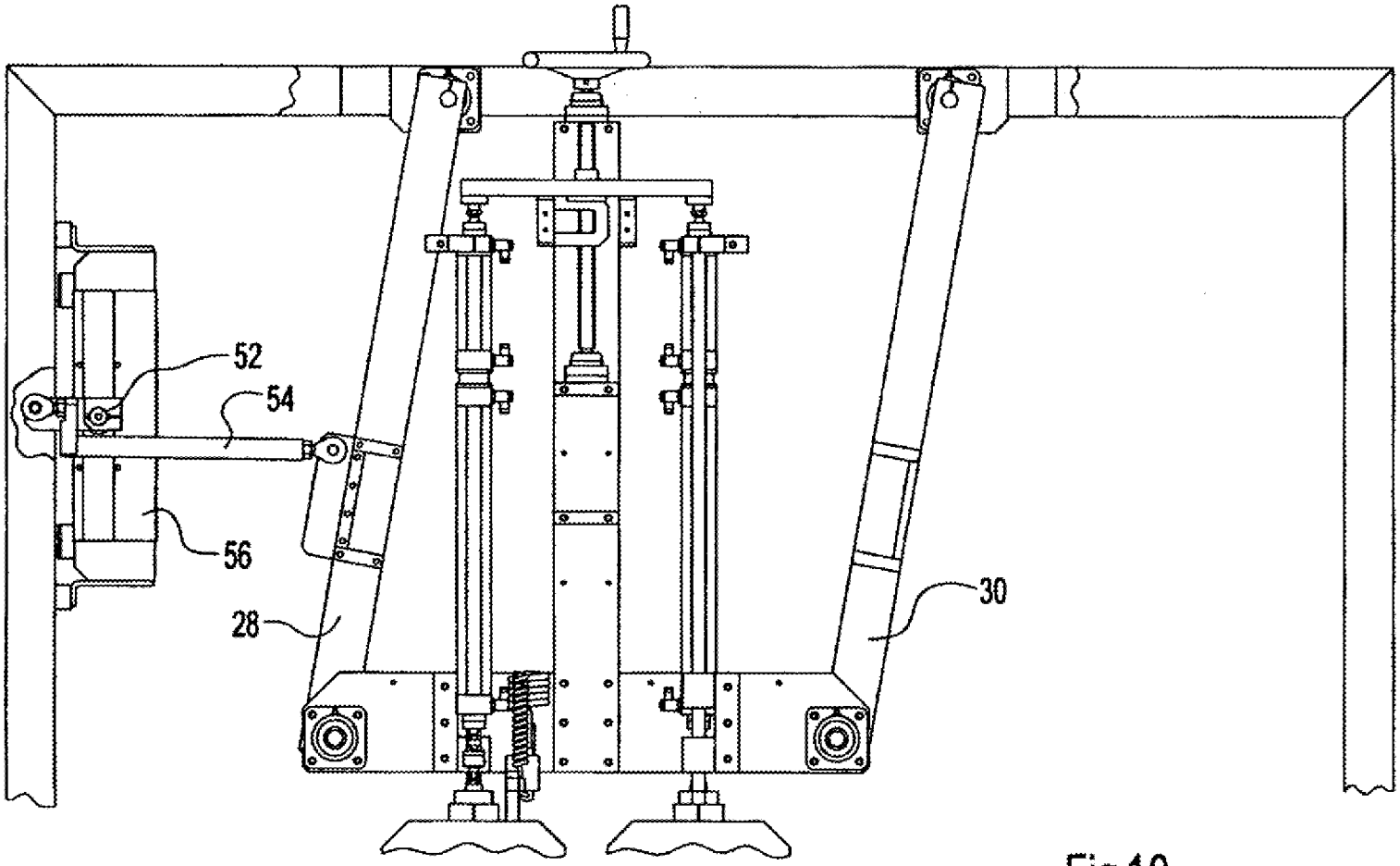

Referring now to FIGS. 1, 2, and 3, it will be seen that the invention is illustrated here as applied to a conveyor system 10 having two carton conveyor tracks 12 and 14.

The two carton tracks are delivering filled cartons 16 from other parts of the plant (not shown). The cartons are of rectangular cross section in plan, and are typically filled with some form of liquid product usually a food product such as milk or fruit juice or a soft drink. As is well known in the art, two opposite sides of each carton 16 are squeezed together at their upper ends and are sealed along seam 18 to close them, the other two sides being formed into gussets and held in the seam, all of which is well known in the art and requires no further description. The two carton tracks define ends or transfer locations 20 and 22 which in this case are directed side by side spaced apart from one another, and extend in opposite directions. This is merely a matter of convenience in the plant however, and other arrangements could be used if desired.

Between the two carton conveyor ends or transfer locations 20 and 22 there is a box conveyor track 24.

Boxes or packing cases B are set up in another location in the plant (not shown) and are delivered to along the box conveyor track 24 for packing with cartons from the two ends of carton conveyor track ends 20 and 22 in a manner to be described below. The location of the box track 24 between the two carton conveyor ends 20 and 22 has significant advantages for the practice of the invention as will become apparent from the following description. The two carton conveyor tracks and the box conveyor track constitute a "packer station" as referred to herein. This merely for convenience of description and is without limitation. The details of the construction of the conveyors is known in the art and requires no special description. For example it is know that the carton conveyors will deliver cartons to their respective ends at the packer station until a sufficient number of cartons has accumulated to be transferred to the box B at box conveyor 24. The further cartons on that conveyor are then momentarily blocked until transfer takes place. The box conveyor similarly will cause the unfilled box to dwell at the packer station in registration with the two carton conveyor ends until it is filled with cartons, at which point the box conveyor will then move the filled box out of the packing station again.

As explained above the filled cartons are transferred, in groups, alternately, from first one, and then the other of the carton conveyor ends 20 and 22, across to the box B standing on box conveyor 24, between the two conveyor ends 20 and 22. The groups of cartons are usually sized so that one group of cartons will fill one layer of the box, each time a group is transferred to the box.

The boxes may often accept only two layers of cartons, although this is not a limiting factor and the invention is of wider application.

The transfer of the cartons is carried out by the carton packer apparatus, indicated generally as 26, shown in more detail in FIG. 4 through FIG. 9.

The packer apparatus 26 comprises a packer support consisting of two pairs of parallel swing arms 28 and 30.

Arms 28 and 30 are swingably mounted at their upper ends on pivots 32 attached to support frame 34. Arms 28 and 30 can swing from side to side transversely relative to the carton conveyor ends 20 and 22, and over the box conveyor 24. The swinging of the arms takes place at right angles to the axes of the three conveyors, in the embodiment described here, for purpose of explanation only. The lower ends 36 of pairs of arms 28 and 30 are joined by transverse cross bars 38 which hold the pairs of arms parallel.

Supported on the cross bars 38 are two carton gripper heads indicated generally as 40 and 42.

Each gripper head functions to grip a group of cartons on a carton conveyor end by clamping onto the sealed seams 18 on the cartons 16. The gripper head grips and holds the sealed seams of the cartons securely so that the entire group of cartons is lifted in a manner described below, and transferred to the box B on the box conveyor 24.

Each gripper head is controlled in its lateral movement by the swing arms 28 and 30, and by the cross bars 38. Each gripper head is controlled in its vertical movement by respective lifting assemblies 44, and 46. Assemblies 44 and 46 are supported at their upper ends on frame 34 between the two pairs of arms 28 and 30, by centre column 48. In this way the lifting assemblies can swing to and fro in unison with the swinging of arms 28 and 30.

Swinging of the arms and the lifting assemblies is powered by means of a crank shaft 52 mounted on one side of frame 34. A connecting link 54 connects between crank shaft 52 and the arm 28. The crank shaft operates to rotate 180 deg. In one direction, then dwells for a moment and rotates 180 deg. In the opposite direction and dwells again. As the crank shaft rotates, being powered by any suitable power means, such as cylinders 56 the link 54 will swing the arms 28 and 30 to and fro, from side to side, transversely relative to the conveyor ends 20 and 22 and box conveyor 24. Such movement being achieved by a crank shaft with intermittent movement, on a 180 deg semi-rotation, will be a progressive acceleration from standstill followed by a progressive deceleration until it reaches standstill once more. This is especially advantageous for the practice of the invention for reasons described below.

Each of the carton gripper heads 40 and 42 (FIG. 4 to FIG. 9) comprises a head block 58 of rectangular shape in plan, with openings formed therethrough for passage of air lines or some other power source.

Two side walls 60 and 62 extend down from block 58. For the purposes of this description wall 60 is referred to as the right wall, and wall 62 is referred to as the left wall. This is without limitation, and purely to facilitate an understanding of the structure as illustrated. Each of right and left walls 60 and 62 is formed with a plurality of guide bearing openings 64. In this case illustrated there are four such bearing openings 64, although the number is merely for illustration and without limitation. Sliding in the bearing openings are a pair of right pull rods 66 and 68, and a pair of left pull rods 70 and 72. The pairs of pull rods are located parallel in spaced apart relation, in alternate sequence across walls 60 and 62.

In order to clamp onto the top seams 18 of the cartons 16, a plurality of right clamp bars 74 are secured to right pull rods 66 and 68, by set screws 75. A similar set plurality of left clamp bars 76 are secured to left pull rods 70 and 72 by similar set screws 77. The right clamp bars are also provided with respective slide openings 78 for sliding along the left pull bars to which they are not connected. The left clamp bars are provided with respective slide openings 80 for sliding along the right pull bars to which they are not connected.

Right pull rods 66 and 68 are fastened as at right rod ends 82 to the outermost right clamp bar 74. Alongside the two fastened pull rod ends there are two slide bearing openings 78—78, which register with and receive the free ends of left pull rods 70 and 72 for sliding therethrough.

Left pull rods 70 and 72 are fastened as at left rod ends 84, to the outermost left clamp bar 76. Alongside the two fastened left pull rod ends there are two slide bearing openings 80—80 which register with and receive the free ends of right pull rods 66 and 68 for sliding therethrough.

The right and left walls 60 and 62 are fixed in position being attached to headblock 58. However the right clamp bars 74 are moveable away from or towards the left clamp bars 76, with the right pull rods 66 and 68 sliding in the bearing openings 80 in left clamp bars 76, and with the left pull rods 70 and 72 sliding in the bearing openings 78 in the right clamp bars 74. Movement of the right and left clamp bars 74 and 76 is powered by right and left air cylinders 86 and 88. Respective cylinders are connected to header block 58 by centre bolt 90 and extend between respective right and left side walls. The cylinders are thus secured to the median of the underside of head block 58.

Right and left side walls 60 and 62 are provided with piston rod openings 92. Right and left piston rods 94 and 96 extend from their respective cylinders through their respective openings in the right and left side walls 60 and 62. The outer ends of the piston rods 94 and 96 are secured to respective right and left frame plates 98 and 100. Frame plate 98 is secured to two of the right clamp bars 74, which are also secured to right rods 66 and 68 by set screws. The other three right clamp bars 74 are merely secured to right pull rods 66 and 68, by set screws but are not secured directly to the frame plate 98. All five of right clamp bars are thus joined together on rods 66 and 68, and thus move in unison powered by right cylinder 86.

Frame plate 100 is secured to two of the left clamp bars 76, which are also secured to left pull rods 70 and 72 by set screws. The other three left clamp bars 76 are merely secured to left pull rods 70 and 72, but are not secured directly to frame plate 100. All five of the left clamp bars are thus joined together on rods 70 and 72, and are thus moveable in movement in unison, and are powered by left cylinder 88.

When the frame plates 98 and 100 are moved apart, by the pistons and piston rods, the right and left clamp bars 74 and 76 are drawn together, thus damping on the top seams 18 of the cartons 16.

When the frame plates 98 and 100 are moved towards one another, the right and left clamp bars will move apart, releasing their grip on the carton seams and allowing the cartons to fall away from the clamp bars.

In order to provide a secure grip on the seams the clamp bars are provided with resilient friction strips 102. Strips 102 are stretchable lengthwise. When stretched they reduce in cross section. Generally wedge shaped grooves 104 are formed in clamp bars 74 and 76 in opposition to one another. The strips may be placed in the grooves by simply stretching the strips until they are thin enough to fit into the grooves, They are then relaxed, and they expand to fill the grooves and are firmly retained therein by their own inherent resilience.

This permits the strips to be replaced as they wear down, with a minimum of downtime.

In operation cartons carried on each carton conveyor track 12 and 14 accumulate in groups at the conveyor ends 20 and 22. Empty set up boxes are delivered along the box conveyor 24, and the end most box B will halt in registration with the carton conveyor ends 20 and 22.

The swing arms 28 and 30 are powered by crank shaft 52, which rotates 180 deg in one direction, then dwells, and then rotates back 180 deg in the other direction and so on. Such movement starts from a standstill at each semi-rotation and is a progressive acceleration and deceleration. At each end of their swing the arms will halt and dwell momentarily before they reverse their movement. Such intermittent swinging movement will bring a respective one of the two gripper heads 40 and 42 into registration with a respective group of cartons on the carton conveyor end 20 or 22, beneath the head, and will bring the other gripper head into registration with the open box on box conveyor 24.

At this moment the swinging movement stops and the one lifting assembly 44 or 46 lowers the respective gripper head down onto the upper ends of the group of cartons. At this point the clamp bars 74 and 76 of that gripper head will be in their open position. The pairs of right and left clamp bars thus fit around their respective the seams 18 of the group of cartons standing on the carton conveyor end. The cylinders 86 and 88 are then operated to bring the right and left clamp bars 74 and 76 together. This will cause the clamp bars to squeeze and grip the seams of their respective cartons.

Simultaneously the other of lifting assemblies 44 or 46 lowers its respective gripper head, this one already carrying a group of cartons, down into the open box B. Its clamp bars are then opend to release its group of cartons in the box. The two lifting assemblies are then operated to lift their respective gripper heads This will lift the group of cartons carried by the one gripper head, while the other gripper head is lifted clear of the box.

The swing arms 28 and 30 now swing in the opposite direction. This will bring the loaded gripper head into registration with the open box on the box conveyor 24.

The lifting assembly for that gripper head is then operated to lower the gripper head downwardly, and deposit the group of cartons in the box B. The cylinders 86 and 88 are then operated to release the cartons, leaving them in the box. While this is taking place the other of the two gripper heads will have moved into registration with a group of cartons on the other carton conveyor end. Its lifting assembly will lower that gripper head down, and the group of cartons will be gripped and lifted in the manner described above. The arms then swing back again, bringing the now loaded gripper head into registration with the open box. Its lifting assembly will then operate to lower the gripper head, and the clamp bars will open, thereby releasing the cartons in the box. Assuming the box is now full it will move on, away from the carton conveyor ends, to be sealed at a glueing station (not shown) of a type well know in the art.

A fresh set up empty box will move into its place.

This process goes on continually, so long as cartons are being filled.

The swing arms will swing continually to and fro, stopping at the end extent of each swing to allow the gripping and lifting of one group of cartons from first one conveyor end, while cartons removed from the other conveyor are being packed and released into the box.

It is understood that the use of a crankshaft drive having a 180 deg semi-rotary movment for swinging the arms is particularly advantageous for the practice of the invention. Such movement takes place at speeds varying from a stationary standstill up to a maximum and back to standstill. This enable the gripper heads to register with, clamp and lift the groups of cartons while at a standstill, with the actual transfer movement speeding up once the cartons have been lifted, and then slowing again and coming to a standstill while the cartons are lowered into the box and released.

However it is understood that the invention is not exclusively limited to such a crank shaft drive. Other drive devices could produce the same type of movement if suitably designed for the purpose.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Carton gripper apparatus for gripping groups of cartons for packing said groups into boxes, and comprising;

a gripper body member;

a first and a second pair of non-rotatable slide rods supported on said gripper body member;

a first pair of clamp bars slideable along said first pair of said slide rods;

a second pair of clamp bars slideable along said second pair of said slide rods, relative to said first pair of clamp bars;

bearing openings in said clamp bars, and wherein said slide rods extend through respective said bearing openings thereby to permit said sliding of said clamp bars along respective said pairs of said slide rods;

fastening means securing said first pair of clamp bars to said second pair of slide rods;

fastening means securing said second pair of clamp bars to said first pair of slide rods; and, means for moving said first pair of slide rods in one direction while simultaneously moving said second pair of slide rods in the opposite direction to said first pair of slide rods, thereby sliding said first pair of clamp bars along said first pair of slide rods, and sliding said second pair of clamp bars along said second pair of slide rods, and thereby moving said first and second pairs of clamp bars towards one another into a gripping position and away from one another into a releasing position.

2. Carton gripper apparatus for gripping groups of cartons for packing as claimed in claim 1 and wherein said first pair of clamp bars are secured by screw means to said second pair of said slide rods, and wherein second pair of said clamp bars are secured to said first pair of said slide rods by screw means said screw means thereby preventing sliding of respective said pairs of clamp bars relative to respective said slide bars to which they are secured.

3. Carton gripper apparatus for gripping groups of cartons for packing as claimed in claim 2 and wherein each of said first pair of slide rods are moveable to move said second pair of clamp bars, and wherein each of said second pair of slide rods are moveable to move said first pair of clamp bars.

4. Carton gripper apparatus for gripping groups of cartons for packing as claimed in claim 3 and including a head plate, and two side walls depending downwardly therefrom, slide openings in said side walls for receiving said first and second pairs of slide rods therethrough, and power means supported by said head plate and operatively connected to respective first and second pairs of clamp bars.

5. Carton gripper apparatus for gripping groups of cartons for packing as claimed in claim 4 and including rods extending from said power means, and being connected to said first and second pairs of clamp bars, and being operable to move said first and said second pairs simultaneously towards or away from one another.

6. Carton gripper apparatus for gripping groups of cartons for packing as claimed in claim 1 and wherein said first pair of clamp bars comprises an end damp bar and an intermediate clamp bar, wherein said end clamp bar in said first pair is secured to said second pair of said slide rods, and wherein said second pair of said clamp bars comprises an end clamp bar and an intermediate damp bar wherein said end damp bar in said second pair is secured to said first pair of said slide rods.

7. Carton gripper apparatus for gripping groups of cartons for packing as claimed in claim 6 and including first and second frame plates connected to respective said intermediate clamp bars in respective first and second pairs.

8. Carton gripper apparatus for gripping groups of cartons for packing as claimed in claim 7 and including rods extending from said power means, and being connected to said first and second frame plates and being operable to procure relative movement of said first and said second pairs of damp bars simultaneously towards or away from one another.

9. Carton gripper apparatus for gripping groups of cartons for packing as claimed in claim 6 and including third and fourth pairs of said clamp bars.

10. Carton gripper apparatus for gripping groups of cartons for packing as claimed in claim 6 and including fastening devices extending between said first clamp bars and said second pair of slide rods, and fastening devices extending between said second clamp bars and said first pair of slide rods.

* * * * *

UNITED STATES PATENT AND TRADEMARK OFFICE

CERTIFICATE OF CORRECTION

PATENT NO. : 6,868,651 B1
APPLICATION NO. : 09/660404
DATED : March 22, 2005
INVENTOR(S) : Sorensen It is certified that error appears in the above-identified patent and that said Letters Patent is hereby corrected as shown below:

Delete Title page illustrating a figure(s), and substitute therefor, new Title page illustrating a figure(s). (attached)

Delete drawing sheets 1-10, and substitute therefor drawing sheets 1-10. (attached)

Signed and Sealed this

Twelfth Day of February, 2008

JON W. DUDAS
*Director of the United States Patent and Trademark Office*

(12) United States Patent
Sorensen

(10) Patent No.: US 6,868,651 B1
(45) Date of Patent: Mar. 22, 2005

(54) PACKER APPARATUS, PACKING CONVEYOR AND METHOD

(76) Inventor: Ejler I. Sorensen, 15 Westchester Blvd, Bolton, Ontario (CA), L7E 5Y1

( * ) Notice: Subject to any disclaimer, the term of this patent is extended or adjusted under 35 U.S.C. 154(b) by 474 days.

(21) Appl. No.: 09/660,404

(22) Filed: Sep. 12, 2000

(51) Int. Cl.[7] ..... B65B 1/04

(52) U.S. Cl. ..... 53/247; 294/119.1; 294/87.1

(58) Field of Search ..... 53/443, 147, 531, 53/542, 247; 211/124; 294/119.1, 87.26, 87.1; 493/473, 479; 269/43, 45, 258; 29/281.1

(56) References Cited

U.S. PATENT DOCUMENTS 3,166,207 A * 1/1965 Quayle ..... 414/621
3,893,574 A * 7/1975 Kamphues ..... 294/63.1
3,910,622 A * 10/1975 Nies ..... 294/87.2
4,120,526 A * 10/1978 Rohner ..... 294/87.1
4,211,056 A * 7/1980 Birk ..... 53/543
4,750,132 A * 6/1988 Pessina et al. ..... 414/751.1
5,127,695 A * 7/1992 Zoeten ..... 294/67.33
5,186,515 A * 2/1993 Goldberg et al. ..... 294/119.1
5,284,003 A * 2/1994 Goodman et al. ..... 53/437
5,655,355 A * 8/1997 Ramler ..... 53/475
5,942,188 A * 8/1999 Lepper et al. ..... 422/62
6,135,435 A * 10/2000 Schmitz ..... 269/164
6,135,704 A * 10/2000 Seaberg ..... 414/791.6
6,196,536 B1 * 3/2001 Hintze ..... 269/282
6,309,003 B1 * 10/2001 Bertini ..... 294/119.1

* cited by examiner

*Primary Examiner*—Eugene Kim
*Assistant Examiner*—John Paradiso

(57) ABSTRACT

A packer for packing cartons into boxes having at least one carton transfer location where cartons accumulate for transfer, a box packing location adjacent the transfer location, clamps for gripping the cartons in a group at the transfer location, the clamps being movable for moving the gripped group of cartons from the transfer location to the packing location, and, being releasable for depositing the group of cartons in the box at the packing location. Also disclosed is a carton gripper for gripping groups of cartons, moving the cartons and for packing the groups into boxes and having, a gripper body, slide rods supported on the gripper body, pairs of clamp bars slideable along the slide rods, and, the gripper being movable moving the pairs of clamp bars towards one another into a gripping position and away from one another into a releasing position. Also disclosed is a method of gripping a group of cartons and transferring them from a conveyor into a box.

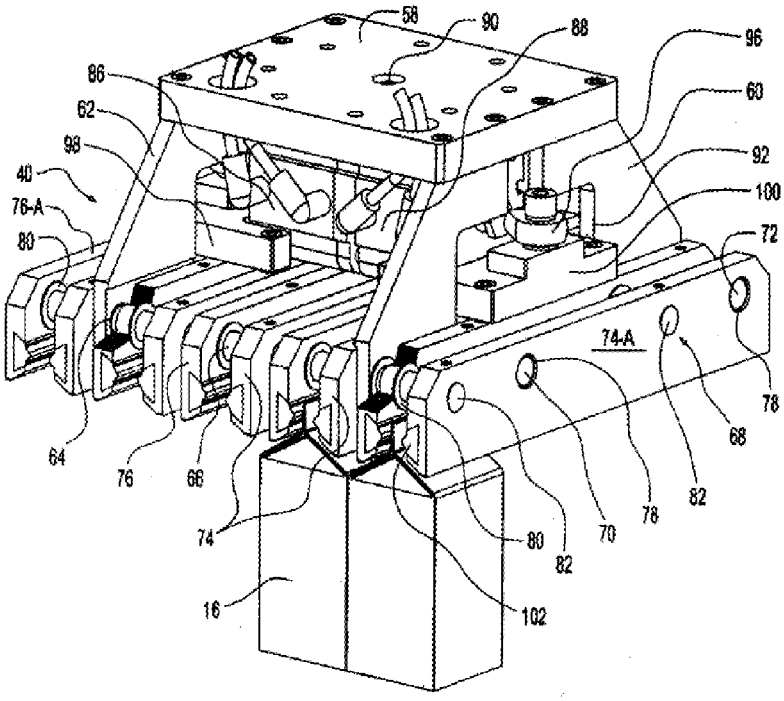

10 Claims, 10 Drawing Sheets